US006764174B2

(12) United States Patent
Sekiya

(10) Patent No.: US 6,764,174 B2
(45) Date of Patent: Jul. 20, 2004

(54) INK-JET RECORDING DEVICE AND COPIER

(75) Inventor: Takuro Sekiya, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/175,181

(22) Filed: Jun. 19, 2002

(65) Prior Publication Data

US 2003/0016269 A1 Jan. 23, 2003

(30) Foreign Application Priority Data

Jun. 21, 2001 (JP) ..... 2001-188723
Apr. 23, 2002 (JP) ..... 2002-120163

(51) Int. Cl.[7] ..... B41J 2/01
(52) U.S. Cl. ..... 347/102
(58) Field of Search ..... 347/42, 102; 101/488; 219/216; 346/25

(56) References Cited

U.S. PATENT DOCUMENTS 5,041,846 A * 8/1991 Vincent et al. ..... 347/102
5,293,182 A 3/1994 Sekiya et al.
5,376,957 A * 12/1994 Gandy et al. ..... 347/3
5,389,962 A 2/1995 Sekiya et al.
5,412,413 A 5/1995 Sekiya et al.
5,420,618 A 5/1995 Sekiya et al.
5,467,119 A * 11/1995 Richtsmeier et al. ..... 347/102
5,610,637 A 3/1997 Sekiya et al.
5,657,060 A 8/1997 Sekiya et al.
5,729,257 A 3/1998 Sekiya et al.
5,754,202 A 5/1998 Sekiya et al.
5,754,208 A * 5/1998 Szlucha ..... 347/102
5,864,352 A * 1/1999 Aoki et al. ..... 347/102
5,877,786 A 3/1999 Sekiya et al.
6,039,425 A 3/2000 Sekiya et al.
6,147,777 A * 11/2000 Jung ..... 347/102
6,193,348 B1 2/2001 Sekiya et al.
6,227,639 B1 5/2001 Sekiya et al.
6,244,700 B1 * 6/2001 Kimura et al. ..... 347/102
6,338,545 B1 1/2002 Sekiya
6,390,618 B1 * 5/2002 Wotton et al. ..... 347/102
6,428,160 B2 * 8/2002 Roy et al. ..... 347/102
6,502,922 B2 * 1/2003 Kawase et al. ..... 347/42
6,508,552 B1 * 1/2003 Steinfield et al. ..... 347/102

FOREIGN PATENT DOCUMENTS

| | | |
|---|---|---|
| JP | 62-144954 | 6/1987 |
| JP | 2-151444 | 6/1990 |
| JP | 2-179771 | 7/1990 |
| JP | 3-169644 | 7/1991 |
| JP | 10-6488 | 1/1998 |
| JP | 11-277722 | 10/1999 |
| JP | 2000-272104 | 10/2000 |
| JP | 2001-47630 | 2/2001 |
| JP | 2002-120163 | 2/2002 |

* cited by examiner

*Primary Examiner*—Thinh Nguyen
*Assistant Examiner*—Julian D. Huffman
(74) *Attorney, Agent, or Firm*—Cooper & Dunham LLP

(57) ABSTRACT

A multi-nozzle recording head has heating elements in a density in a range between 400 and 2400 dpi arranged on a substrate. Ink is fired out through a nozzle by a function of growth of air bubble generated in a recording liquid in each heating element. The multi-nozzle recording head has a dimension such as to cover a recording range of a recording medium which is conveyed by a conveyance belt to a position at which the nozzle surfaces of said recording head face said recording medium.

7 Claims, 10 Drawing Sheets

INK-JET RECORDING DEVICE AND COPIER

BACKGROUND OF THE INVENTION

1. Field of the Invention

The present invention relates to an ink-jet recording device, and a copier, and, in particular, to an ink-jet recording device including a heating-type fixing device which carries out heating fixing of liquid used for recording by making adhesion thereof to a recording surface of a recording medium, and, to a copier employing such a type of an ink-jet recording device.

2. Description of the Related Art

An ink-jet recording device performing recording by firing ink and making it adhere to a recording surface of a recording medium is put into a practical use widely. In an ink-jet recording device, generally speaking, a recording head is provided which has an ink firing nozzle provision surface which fires ink to a recording surface of a recording medium.

Such a recording head fires an ink drop formed by a pressure of an electromechanical transformation device or a heating energy of a thermoelectrical transformation device controlled based on a driving control signal supplied according to image data, to a recording surface of a recording medium through the ink firing nozzle provision surface.

In the recording head, in order to attain improvement in the speed of recording speed, a so-called multi-nozzle type is used in which ink firing nozzles are arranged at a comparatively high-density, i.e., for example, 400 dpi through 600 dpi, or ink nozzles are provided throughout a recording range, for example, throughout the width of recording medium.

In such a long-sized recording head, since ink is fired out comparatively so much for a short time, an ink firing amount increases compared with a conventional recording head, and dryness thereof comes to take a time on the recording medium.

Moreover, since an ink adhering to the recording surface of the recording medium has a possibility of causing a blot of the ink resulting from mixture of various colors of the ink as the number of ink nozzles increases and recording speed becomes higher, it is necessary to fix the ink onto the record surface of the recording medium positively within a short time.

A heat fixing scheme by which the ink adhering to the recording surface of the recording medium is dried by heating has been known as an effective method for fixing ink on the recording surface of the recording medium. However, concerning the dryness of the ink on the recording medium in a condition in which a recording head has many ink firing nozzles arranged there and having a long dimension has not yet been studied enough.

SUMMARY OF THE INVENTION

The present invention has been devised in consideration of the above-described situation, and, a first object of the present invention is to provide a page-printer-type ink-jet recording device having a long dimension in recording head and high density in nozzles such as to cover the entire printing width of a recording medium, and in which, a recording medium is carried by a carrying belt, and, thereby, an image formed thereon before dryness is prevented from being degraded, and, also, high-speed recording such as tens of sheets per minute, high definite and high quality image recording can be achieved.

An ink-jet recording device according to the present invention includes:

a multi-nozzle recording head having heating elements in a density in a range between 400 and 2400 dpi arranged on a substrate, wherein ink is fired out through each nozzle by a function of growth of air bubble generated in a recording liquid in each heating element, wherein said multi-nozzle recording head has a long dimension so as to cover a printing range of a recording medium which is conveyed by a conveyance belt to a position at which the nozzle surface of said recording head face said recording medium.

Thereby, it is possible to prevent an image printed on the recording medium thereby from degraded even before the image has not been dried sufficiently.

The recording medium used there may preferably comprise a coating paper having a material coated on a base material such that the ink adhering thereto is easy to be absorbed thereinto Thereby, the image printed is easy to be dried, and, thus, even the thus-obtained printed matters are stocked in a condition in which they are stacked on each other, each image on the printing surface can be prevented from penetrating to the rear surface or from being degraded The ink-jet recording device may further include a recording medium heating unit for heating the recording medium and extending along a direction along which the nozzles of said recording head are arranged, wherein the heating range of said heating unit covers a range wider than the printing range of the recording medium in which printing is performed by said recording head.

Thereby, the heating unit thus has a sufficient heating capability and, thus, can effectively dry and fix the ink on the recording medium.

The heating unit may preferably have a function of heating the printing surface of the recording medium not in contact with the recording medium.

Thereby, it is possible to prevent printed dots formed on the recording medium from deformed by the heating unit. Accordingly, it is possible to effectively dry and fix the ink on the recording medium without degrading the image quality.

The ink-jet recording device may further include a rear heating unit provided on the rear side of the recording medium, having a heating range extending along the direction along which the nozzles of said recording head are arranged, wider than the printing range of the recording medium.

Thereby, it is possible to further effectively dry and fix the ink on the recording medium.

The rear heating unit may preferably have a function of heating the recording medium in contact with the recording medium.

Thereby, it is possible to further effectively dry and fix the ink on the recording medium.

The heating unit may have a light source and an optical system condensing the light emitted by the light source.

Thereby, it is possible to momentarily heat the printing surface of the recording medium, and, thus, to effectively dry and fix the ink on the recording medium.

The heating unit may be a roller heating the printing surface of said recording medium in contact therewith, and having an ink-repellent material provided on the surface thereof.

Thereby, it is possible to effectively dry and fix the ink on the recording medium without degrading the image formed thereon by the ink.

An ink-jet copier according to the present invention includes:

a scanner part reading an image of an original; and a recording part performing a recording operation by firing ink onto a printing surface of a recording medium based on image data supplied from said scanner part, wherein the recording part comprises a plurality of recording heads for respective color components each having heating elements in a density in a range between 400 and 2400 dpi arranged on a substrate, wherein ink is fired out through a nozzle by a function of growth of air bubble generated in a recording liquid in each heating element which is driven according to the image data, wherein said each recording head has a long dimension so as to cover a printing range of the recording medium which is conveyed by a conveyance belt to a position at which the nozzle surfaces of each recording head face the recording medium.

Other objects and further features of the present invention will become more apparent from the following detailed description when read in conjunction with the accompanying drawings.

DETAILED DESCRIPTION OF THE PREFERRED EMBODIMENTS

Hereafter, embodiments of the present invention will now be described with reference to FIGS. 1 through 10.

Figure 1:
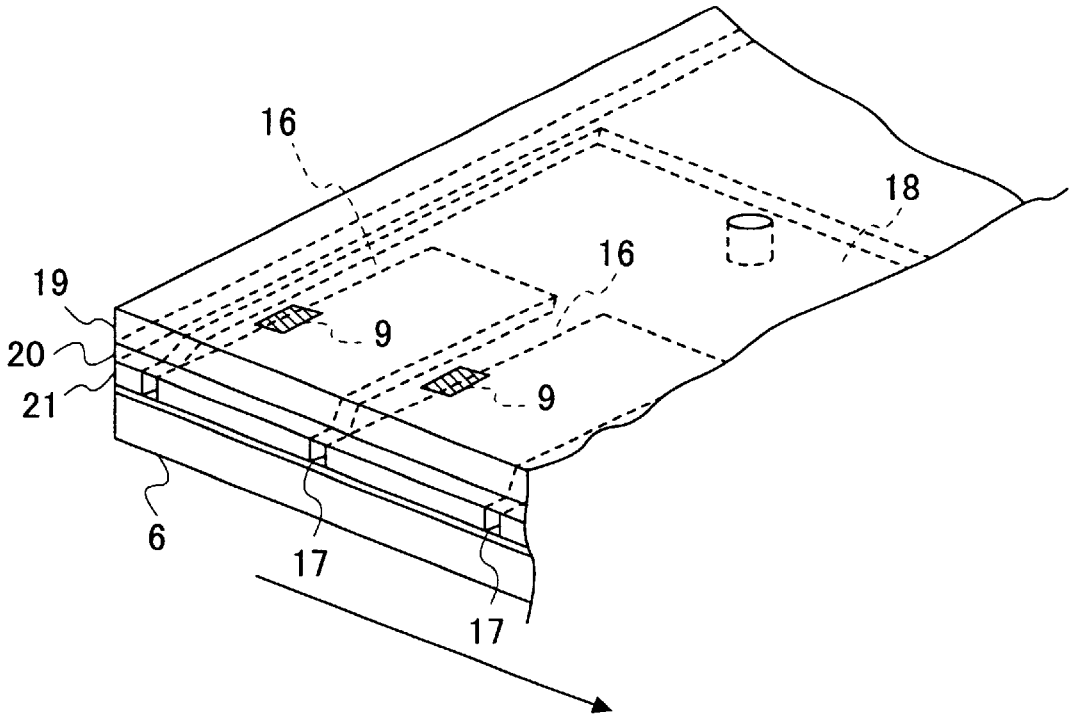
FIG. 1 shows a partial perspective view of a thermal ink-jet recording head according to the present invention.

FIG. 1 shows a partial perspective diagram for illustrating an example of a multi-nozzle type ink-jet recording head used for an ink-jet recording device according to the present invention. A structure of the ink-jet recording head shown there is merely an example, which is a thermal ink-jet type one having a high-nozzle density arrangement, i.e., 400 dpi through 2400 dpi.

In the multi-nozzle type ink-jet recording head shown in FIG. 1, flow paths 16, nozzles 17, a common liquid chamber 18, a ceiling plate 19, a bonding layer 20, and a flow path barrier 21 are provided. Actually, the multi-nozzle type ink-jet recording head has a long dimension so as to cover a printing width of a recording medium, although FIG. 1 shows merely a part for three nozzles, and has thousands through tens of thousands of nozzles arranged in a row along the direction of arrow shown in the figure.

Figure 2A:
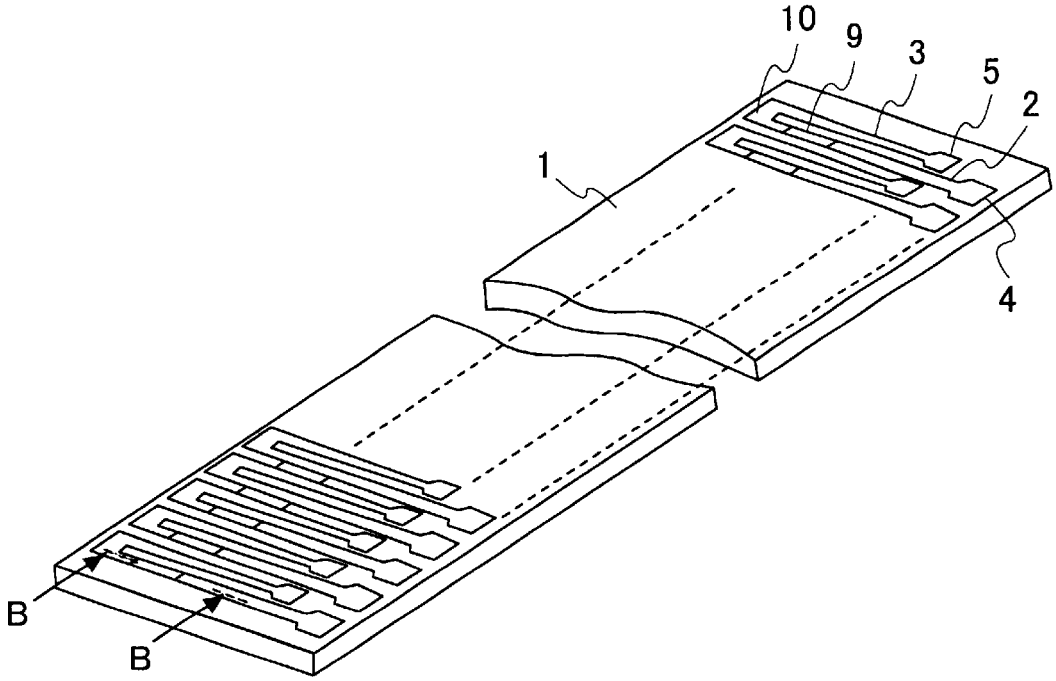
FIGS. 2A and 2B illustrate a heating element substrate applied to the thermal ink-jet recording head according to the present invention.
Figure 2B:
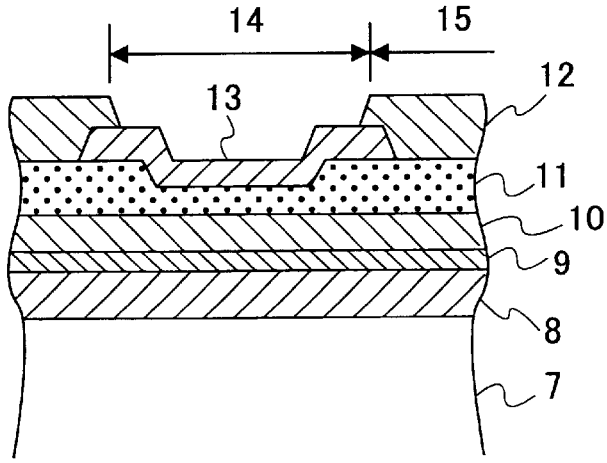

FIGS. 2A and 2B shows a heating element substrate used in the thermal ink-jet recording head shown in FIG. 1, and, FIG. 2A shows a perspective view thereof while FIG. 2B shows a sectional view thereof taken along a plane B—B shown in FIG. 2A. and shows a detail around heating elements.

The heating element substrate 1 shown in FIGS. 2A and 2B is provided with a first electrode (control electrode) 2, a second electrode (ground electrode) 3, bonding pads 4, 5, a substrate 7, a thermal accumulation layer ($SiO_2$), a heating element ($HfB_2$), an electrode (aluminum) 10, a protection layer ($SiO_2$) 11, an electrode protection layer (resin) 12, and another protection layer 13. A heating element part 14 and an electrode part 15 are also indicated in the figure. In addition, in order to avoid complexity, only the heating element 9 and electrode 10 are shown in FIG. 2A.

The heating element substrate 1 has a configuration, as shown in FIG. 2B, on the substrate 7 made of ceramics, such as alumina, glass, or silicon, the thermal accumulation layer ($SiO_2$) 8, heating element ($HfB_2$) 9, electrode 10, protection layer ($SiO_2$) 11, electrode protection layer 12, and other protection layer 13 are formed in the stated order by pattern formation technology such as sputtering, and, then, heating element 14 and electrode part 15 are formed on the surface.

Each heating element 9 is, as shown in FIG. 2A, connected with the first electrode (control electrode) 2 and second electrode (ground electrode) 3. Each first electrode 2 has the bonding pad 4 while each second electrode 3 has the bonding pad 5 at the end thereof, respectively. These pads are connected with an image information input unit (not shown in the figure), and thereby, each heating element 9 is driven thereby independently. It is also possible that the second electrode 3 is provided as a common electrode for a plurality of heating elements 9, i.e., a plurality of first electrodes 2. Moreover, it is also possible to provide a configuration such that each heating element is not driven independently, but is driven in a matrix manner. A row of such heating elements 9 may have a density of, for example, 400 dpi through 2400 dpi, and, thus, depending on an actual printing width of a recording medium, thousands through tens of thousands thereof are provided.

The thermal accumulation layer 8 is formed on the substrate 7. This thermal accumulation layer 8 is provided so as to avoid heat generated by the heating element 9 from escaping toward the substrate 7. That is, it is provided for the heat generated to finally generate air bubbles stably as a result of this heat being transmitted into ink efficiently. Usually, as the thermal accumulation layer 8, $SiO_2$ is used, and, specifically, for this layer 8, $SiO_2$ is used for forming a film having a thickness in a range between 1 micrometer through 5 micrometers using film formation technology, such as sputtering.

As shown in FIG. 2B, the layer of heating element 9 is formed on the thermal accumulation layer ($SiO_2$) 8, and, as the material of the heating element 9, a mixture of tantalum and $SiO_2$, tantalum nitride, nichrome, silver-and-palladium alloy, silicone semiconductor, or a boride of metal such as hafnium, lantern, zirconium, titanium, tantalum, tungsten, molybdenum, niobium, chromium, vanadium, or the like may be employed.

Hafnium boride ($HfB_2$) is most excellent among the metal boride, and, subsequently zirconium boride, lanthanum boride, tantalum boride, vanadium boride, and niobium boride are superior in the stated order.

The heating element 9 can be formed by a technique, such as electron-beam deposition, sputtering, or the like, using the above-mentioned material. The thickness of the heating element 9 is determined depending on the area, material, shape, size of heating functioning portion thereof, and also, it is determined further according to the requirement on the power consumption saving. In an ordinary case, it is in a range between 0.001 micrometers and 5 micrometers, more preferably, a range between 0.01 micrometers and 1 micrometer.

According to each specific embodiment of the present invention, the heating element 9 is formed through sputtering of $HfB_2$ into the thickness of 2000 Å (0.2 micrometers).

As a material of the electrode 10, many matters as electrode materials ordinarily used for such an electrode in the prior art may be used effectively, and, specifically, Al, Ag, Au, Pt, Cu, or the like may be used. By using it, at a predetermined position in a predetermined size, shape, and thickness, depending on a technique, such as vacuum evaporation, the electrode 10 is formed. According to each specific embodiment of the present invention, 1.4 micrometers of aluminum film is formed by sputtering.

The characteristics required on the protection layer 11 is not only anti-corrosion property against the ink and protection against mechanical impact caused by disappearance of air bubbles (cavitation-proof nature) but also transmitting effectively the heat generated by the heating element 9 into heat sensing paper, ink ribbon, or into the ink acting as the recording liquid.

For example, silicon oxide, silicon nitride, magnesium oxide, aluminum oxide, tantalum oxide, zirconium oxide, or the like may be used as the material of the protection layer 11, and it may be formed by using a technique, such as electron-beam deposition, sputtering or the like. Moreover, a ceramic material, such as silicon carbide, aluminum oxide (alumina), may also be preferably used.

The film thickness of the protection layer 11 should be made to fall within a range between 0.01 micrometers and 10 micrometers, preferably, within a range between 0.1 micrometers and 5 micrometers, and, most preferably, within a range between 0.1 micrometers through 3 micrometers. According to each specific embodiment of the present invention, 1.2 micrometers of $SiO_2$ film is formed by sputtering.

Further, as shown in FIG. 2B, 2 micrometers of resin layer is formed as the electrode protection layer 12. This layer is not necessarily required and may be omitted. In consideration of cavitation-proof nature, as for the material of the protection layer 13, tantalum (Ta) may be preferably used. In the heating element part 14, since the cavitation impact power by bubble generation is applied, for the purpose of protection from destruction, a good performance should be obtained by forming 4000 Å (0.4 micrometers) formation of Ta film by sputtering as the protection layer 13.

Thus, the ink-jet recording head is configured by using the heating element substrate 1.

FIGS. 3A through 3F illustrate a manufacturing process of the thermal ink-jet head in the embodiment of the present invention. Same as in FIG. 1, the ceiling plate 19, bonding layer 20 and flow path barrier 21 are formed, and, also, a photoresist 22 and a photo-mask 23 are utilized.

Figure 3A:
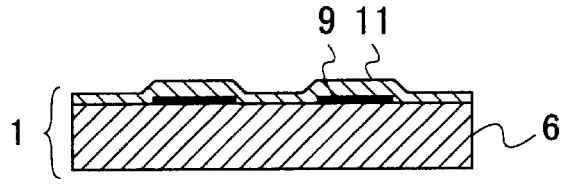
FIGS. 3A, 3B, 3C, 3D, 3E and 3F illustrate a manufacturing process of the thermal ink-jet recording head according to the present invention.

First, as shown in FIG. 3A, the heating element substrate is prepared as follows: On the substrate 6, the heating element 9 and the thin film 11 for protecting and insulating the heating element 9 are formed.

Figure 3B:
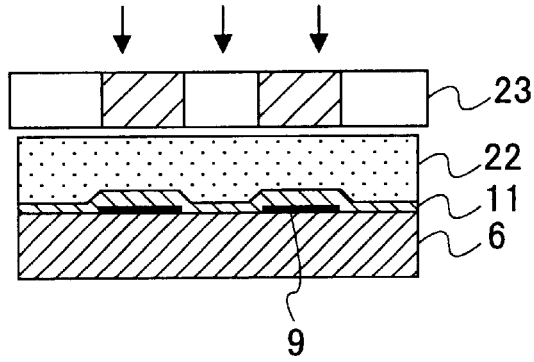

Then, as shown in FIG. 3B, the photoresist is coated on the heating element substrate 1, as follows: On the heating element substrate 1 shown in FIG. 3A, for example, the photoresist 22 on approximately 5 through 30 micrometers in film thickness is formed of a material having the viscosity in a range between 1000 and 2000 cP (centipoises) by spin coating, dip coating, or roller coating. Finally this thickness becomes the height of the flow path barrier 21, and this thickness depends on the arrangement density (printing density) of the heating elements 9. In case the layer of photoresist 22 having the thickness more than 20 micrometers, not a liquefied photoresist but a dry-film-type photoresist should be used.

Then, on the photoresist 22 provided on the surface of the heating element substrate 1 as shown in FIG. 3B, the photomask 23 having a predetermined pattern is put. After that, exposure is performed from the top of this photomask 23. It is necessary to perform proper positioning between the heating element 9, and the above-mentioned pattern at this time.

Figure 3C:
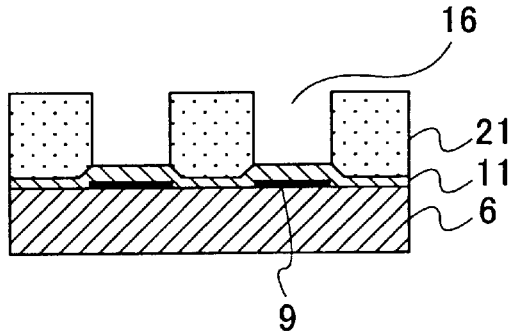

Then, as shown in FIG. 3C, the flow path barrier 21 is formed. Specifically, by using an alkaline developing solution, such as sodium carbonate solution, the non-exposed parts of the photoresist 22 are removed, and then, and the flow path barriers 21 are formed. The thus-removed portions form recess parts which have the heating elements 9, respectively, and also form the flow paths 16 and the common liquid chamber 18.

Figure 3D:
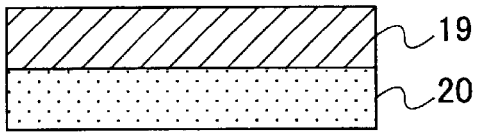

Then, as shown in FIG. 3D, a substrate serving as a ceiling of the flow path 16 and common liquid chamber 18 is produced. The substrate serving as the ceiling of flow path 16 and common liquid chamber 18 is produced by bonding of the bonding layer 20 and glass substrate 19, and the glass substrate 19 serves as the ceiling plate.

Figure 3E:
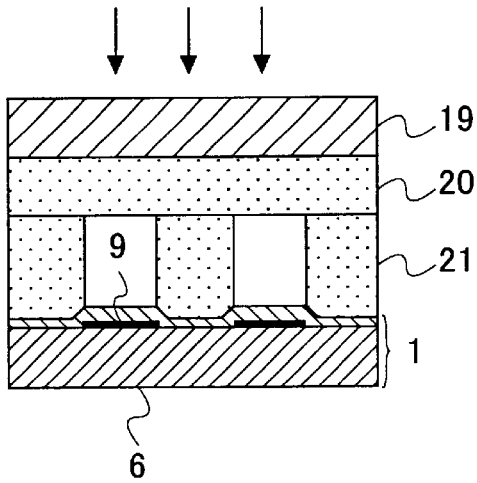

Then, as shown in FIG. 3E, the thus-produced substrate is bonded onto the flow path barrier 21. Specifically, bonding is made such that the photoresist 22 (flow path barrier 21) and bonding layer 20 are made to face one another, between the glass substrate 19 becoming the ceiling plate and the heating element substrate 1. At this time, thermal setting processing (for example, heating for 30 through 60 minutes, at 150 through 250° C.), or ultraviolet irradiation (for example, at ultraviolet intensity equal to or more than 50 $mW/cm^2$ through 200 $mW/cm^2$) is performed so as to improve the bonding strength.

Figure 3F:
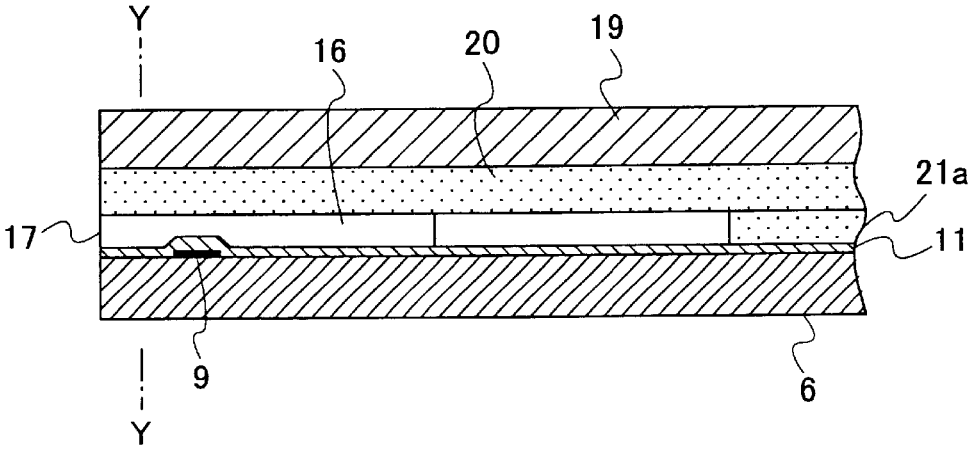
Figure 4A:
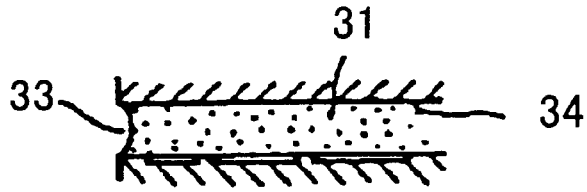
FIGS. 4A, 4B, 4C, 4D, 4E, 4F and 4G illustrate operation of the thermal ink-jet recording head according to the present invention.
Figure 4B:
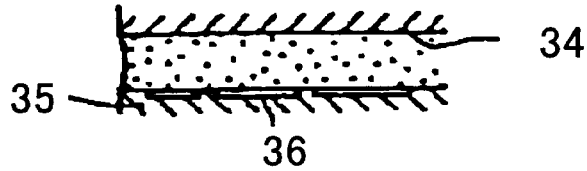
Figure 4C:
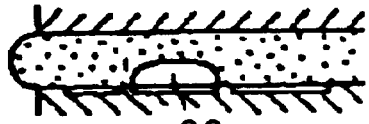
Figure 4D:
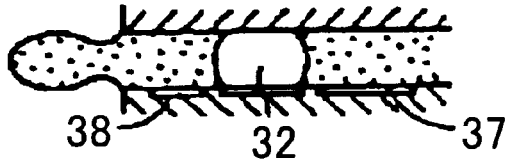
Figure 4E:
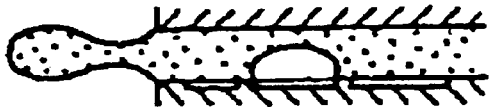
Figure 4F:
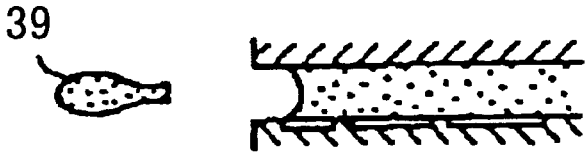
Figure 4G:
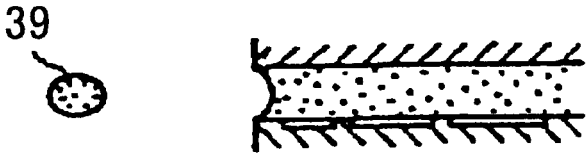

Then, as shown in FIG. 3F, firing nozzles 17 are formed. Specifically, through dicing, the portion of Y—Y line near the openings on the side of the heating elements is cut. Thereby, the firing nozzles 17 are formed, and, thus, the ink-jet recording head is produced.

As another method for manufacturing the nozzles, there is a method of manufacturing the flow paths and common liquid chamber through integral mold by using a resin such as polysulfone, polyethersulfone, polyphenyleneoxide, polypropylene, polyimide or the like.

Alternatively, a resin film may be put on the flow path end, firing nozzles are formed by perforating it by means of an excimer laser, or the like. Since the firfing nozzle formation method by means of the excimer laser elables formation of the nozzles in arbitrary shapes, i.e., a round shape, a polygonal shape, a star shape or the like, by means of a mask shape, this method is superior as the shape of nozzle can be freely determined according to ink firing characteristics. Also in this method, resin, such as polysulfone, polyethersulfone, polyphenyleneoxide, polypropylene, polyimide or the like may be preferably used for the above-mentioned resin film. Next, with reference to FIGS. 4A through 4G, the principle of the ink firing by such an ink-jet recording head will now be described briefly.

As shown in the figures, to each heating element 36, a signal pulse is input through the first electrode 37 and second electrode 38, and an air bubble 32 is generated in the ink according to this input pulse. Thereby, the ink in the flow path 34 is fired as an ink drop 39 from the firing nozzle 33 thanks to the pressure applied by the thus-generated air bubble, and it is used for recording on a recording medium (for example, paper).

The continuation time of this signal pulse (ON period) is preferably several microseconds through ten and several microseconds, and, should not be longer than 30 microseconds. Since the air bubble 32 blocks the heat of the heating element 36 after once the air bubble 32 is generated on the heating element 36, the size of the air bubble 32 hardly changes. Accordingly, it should be useless to elongate the continuation time on the signal pulse so as to supply the electric current to the heating element 36. Rather, the longer continuation time may shorten the lifetime of the heating element 36.

After the energization of the heating element 36 is terminated, the heat of the air bubble 32 is removed by the heating element substrate 35 and the peripheral ink, and thus, the air bubble 32 becomes smaller and then disappears.

As can be seen from the above description, the air bubble is obtained by heating rapidly very much according to the ink firing principle according to the present invention. Such a type of air bubble is one generated due to so-called 'film boil' in the field of heat conduction industry, and, is superior in reproducibility for repetitive alternate actions of occurrence and disappearing thereof.

Furthermore, it is also possible to configure so that the position of the heating element 36 is made to approach the firing nozzle 33 so as to enable firing of a minute ink drop, the air bubble generated is caused to project externally of the firing nozzle 33, or to explode there.

Moreover, although the above-mentioned description is made also for the manufacturing method assuming the thermal ink-jet-type head, the above description according to the present invention may also be applied to an ink-jet head employing piezo-electric elements, or the like.

Figure 5:
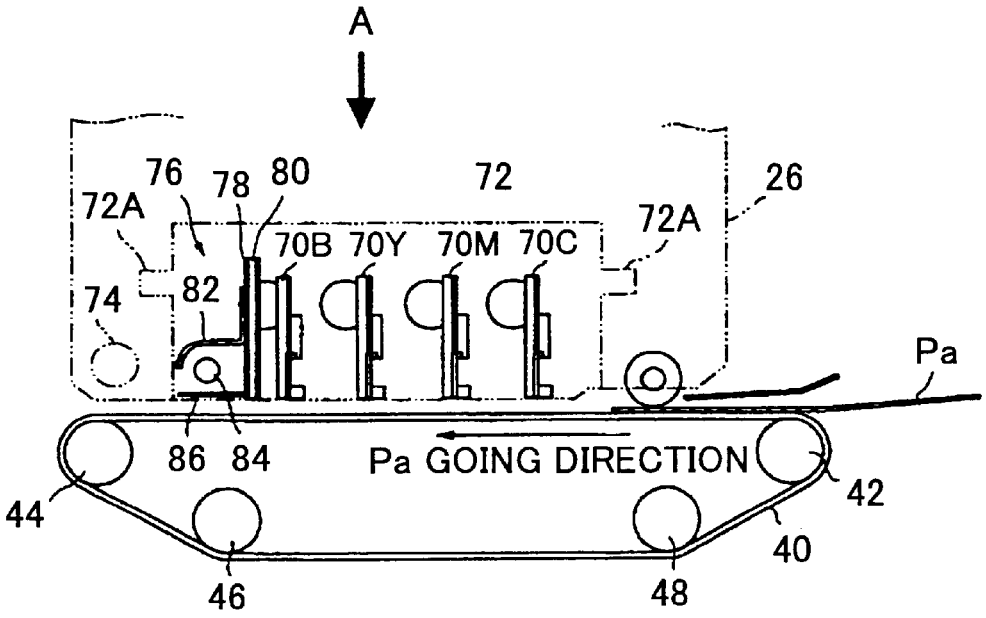
FIG. 5 shows a side-elevational sectional view of a recording part having a heating fixing device in a first embodiment of the present invention.

FIG. 5 shows a recording part 26 in a multi-nozzle type ink-jet recording device having a long dimension so that a plurality of ink firing nozzles cover the printing range of a predetermined recording medium, i.e., paper.

The recording part 26 has a head block 72 having respective recording heads 70C, 70M, 70Y, and 70B on cyan, magenta, yellow, and black, respectively, and a heating-type fixing device 76 which will be described later. The head block 72 is supported inside of the recording part 26 through projection parts 72A provided at the both ends thereof along a conveyance path of the recording medium (paper Pa).

The respective recording heads 70C, 70M, 70Y, and 70B are disposed with predetermined mutual intervals from the upstream end through the downstream end of the conveyance path of the paper Pa in sequence. In this case, the recording heads 70C through 70B are positioned in the head block 72 in a manner such that the flatness on a plane formed by all the firing surfaces (nozzle surfaces) of those heads may fall within tens of micrometers.

The respective recording heads 70C, 70M, 70Y, and 70B are of the above-mentioned thermal ink-jet type, for example, and fire the inks of cyan, magenta, yellow, and black, respectively. That is, the respective recording heads 70C through 70B fire ink drops formed through heating by heaters (as mentioned above with reference to FIGS. 1 through 4G) as thermoelectric transformation elements provided in liquid flow paths which communicate with the firing nozzles.

The respective recording heads 70C through 70B have the plurality of firing nozzles arranged along a direction approximately perpendicular to the conveyance direction of the paper Pa. The plurality of firing nozzles are provided throughout the width of the recording surface of the paper Pa in the direction approximately perpendicular to the conveyance direction of the paper Pa. The paper Pa is conveyed as the rear surface (not-recording surface) of the paper contacts the conveyance belt 40 and pulled thereby. Therefore, this causes no image degradation on the printing surface of the paper Pa.

Recording operations by the respective recording heads 70C, 70M, 70Y, and 70B are performed on the same paper Pa, respectively, and the recording head 70C records first for example, the recording head 70M records second, the recording head 70Y records third, and, finally the recording head 70B records, in sequence.

The recording heads 70C through 70B may not necessarily be those which fire the ink but at least one thereof may fire a treatment liquid which insolubilizes the ink, or fires a treatment liquid onto the paper Pa before the ink firing for avoiding each pixel of the ink formed on the paper Pa from spreading or running much on the paper Pa.

In such a type of ink-jet recording scheme, as ink adheres to a recording material and permeates into this material, the ink is fixed there. Alternatively, adhering ink is fixed through an ink solvent evaporation process.

However, a time required for fixing of the ink since it adheres to the recording material, i.e., a fixing speed, depends not only on a configuration/physical properties of the recording material greatly, but is greatly influenced by the state of external atmosphere. Moreover, the automatically fixing speed cannot be shortened shorter than a predetermined time determined according to the physical properties.

As mentioned above, the speed at which the ink adheres to and permeates into the recording material is influenced by the composition of the ink.

Usually, in many cases, the composition of ink is distinguished by permeability into a recording material of the ink. Generally, ink having high permeability is advantageous, in terms of fixing nature since the ink with high permeability has a high fixing speed onto recording material. However, when the permeability is too high, this means that the ink may spread too wide on the recording medium so as to degrade the image formed thereon. Moreover, when the ink permeates deeply into the recording material, the image tone may become lowered on the recording medium.

On the other hand, as mentioned above, when ink having low permeability is used, a time is required for fixing thereof on a recording material is longer, and, thus, the following problems may occur in a device having a multi-nozzle type ink-jet recording head having a long dimension so as to cover throughout the printing range of the recording medium and directed to high-speed printing. That is, in case of multi-color printing, different colors may be problematically mixed on the recording medium, blots of the ink may occur, or scratch of the printed image may occur when the printed matter is ejected from the device. Therefore, a configuration of the device is required in which the fixing performance, image density, blot, scratch-proof capability are considered well.

In a conventional serial scanning recording device, the necessary ink fixing performance can be achieved merely by a simple configuration as the recording speed required is not so high. However, in order to fix ink to a desired state the ink is fired onto a recording material as mentioned above in case high-speed recording as in the embodiment of the present invention is required, and, especially, color recording/printing is performed, the heating-type ink fixing device 76 which will be described below is needed for shortening the ink fixing time and for increasing the printing efficiency.

The heating-type ink fixing device 76 is provided on the downstream side of and relatively approximate to the recording head 70B along the conveyance path, as shown in FIG. 5. In this embodiment, a halogen heater 84 and a reflective plate 82 made to reflect heat radiation of the halogen heater 84 act as the heating-type ink fixing device 76, for example.

Thus, according to the embodiment of the present invention, non-contacting heating of the printing surface of a recording medium (paper Pa) is achieved. That is, since the heating is made from the top of the surface of the printing area, volatilization elements in the ink, such as water, can be dried out efficiently.

As the heating-type ink fixing device 76, there are provided the halogen heater 84 as the heating part, the reflective plate 82 reflecting the heat radiation from the halogen heater 84, a heating part separating member 86 separating the halogen heater 84 from the conveyance path, a heat insulating device 78 thermally isolating the recording head 70B from the halogen heater 84 so as to avoid the heat of the heater 84 from reaching the recording head 70B.

Specifically, in the embodiment, the halogen heater 84 is provided near the downstream end in the conveyance direction of the paper Pa in the recording part 26, adjacent to the recording head 70B. This is because it is necessary to carry out the thermal fixing with the halogen heater 84 immediately after the image recording by the recording heads 70C through 70B. This halogen heater 84 performs non-contacting heating of the recording surface of the recording medium. By this, the recording surface is dried, dryness of the ink is promoted, and thus, the ink fixing speed is improved remarkably. Furthermore, there is another advantage that it can dry with heating in a non-contacting state, it is possible to prevent the dot shapes formed by the ink on the recording surface of the paper Pa from being deformed and thus, to avoid degradation of the printed image there.

The heating operation is controlled in predetermined timing according to the conveyance of the paper Pa and the recording operation in the recording part 26 by a control unit concerning the halogen heater 84 which will be described later.

Moreover, the halogen heater 84 has a thermostat (not shown) which controls the temperature of the halogen heater 84. The ink fixing temperature is controlled appropriately according to conditions, such as the quality of paper as the recording material, the conveyance speed, required image density/tone, and so forth by means of the thermostat.

As the heating unit for heating a surface (recording surface) of the paper Pa to which the ink adheres, not only the halogen heater but also a halogen lamp, a sheathed heater, a ceramic heater, a thermistor, or the like, for example, may also be used.

The heating part separating member 86 is made of metal wires and provided in a position such as to cover the bottom part of the halogen heater 84 so as to prevent the paper Pa from accidentally contacting the halogen heater 84 in a case of occurrence of paper jamming or the like.

The reflective plate 82 having an end thereof connected with the heat insulation device 80 is made for example, from an aluminum bright alloy, or the like, and it has a curve part which covers the top of the halogen heater 84 as shown in FIG. 5. The reflective plate 82 is configured to reflect the heat radiation from the halogen heater 84 on the inside of the curve part thereof so as to efficiently cause the reflected heat radiation to reach the recording surface of the paper Pa. Alternatively, it is also possible to provide another optical system such as a lens for condensing the heat radiation from the halogen heater 84 onto the recording surface of the paper Pa where the ink adheres to. Moreover, it can be made to dry the ink on the paper Pa more efficiently as a light/heat condensing optical system which includes a combination of such a reflective plate and a lens-like optical system.

As shown in FIG. 5, the heat insulation device 78 is provided between the recording head 70B and the halogen heater 84 in the head block 72, and is made to approach the recording head 70B. The heat insulation device 78 is of a plate-shaped member made of a material superior in heat radiation performance, such as an aluminum alloy, or a heat-resistance plastic material together with a material superior in heat radiation performance such as an aluminum sheet stuck thereonto.

The heat insulation device 78 has a pipe-like shape with an approximately rectangular sectional shape, and has an air layer 80 therein extending along the direction along which the firing nozzles of the recording head 70B are arranged. Further, the top and bottom ends thereof are open to the outside thereof, respectively.

Accordingly, the heat transmission to the recording head 70B of the heat generated by the halogen heater 84 is blocked thereby, and, thus, temperature rise in the recording heads 70C through 70B by the halogen heater is effectively avoided. Moreover, the heat emitted from the halogen heater 84 is transmitted to the heat insulation device 78 by the reflective plate 82, and also, then, it radiates therefrom.

Next, features of the embodiment of the present invention will now be described using FIG. 6.

Figure 6:
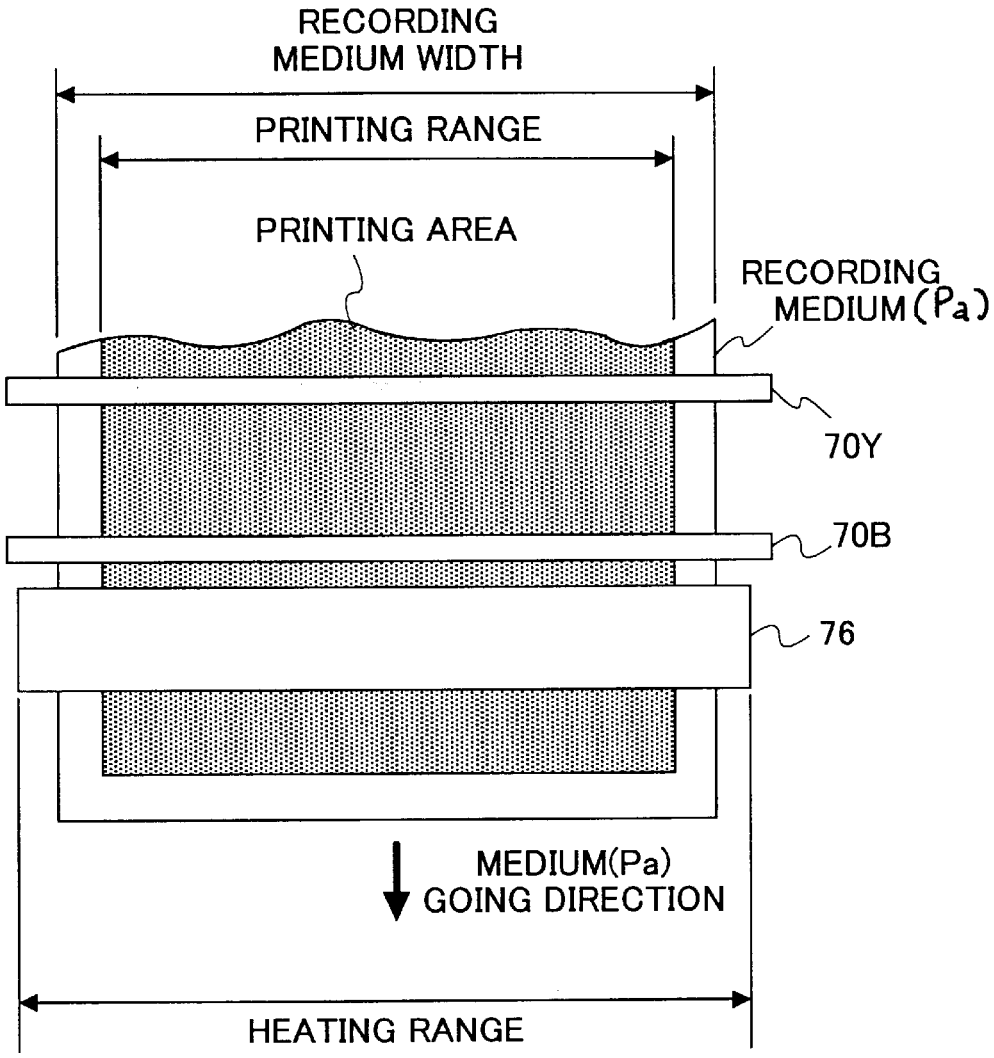
FIG. 6 shows a plan view illustrating a relationship between the heating fixing device and a printing range of a recording medium in the first embodiment of the present invention.

FIG. 6 shows a partial typical view of the recording part 26 taken along an arrow A of FIG. 5 in the multi-nozzle-type ink-jet recording device having a long dimension so that the plurality of firing nozzles shown in FIG. 5 can cover the printing range of the recording medium.

As can be seen from FIG. 6, the heating unit in the form of heating-type ink fixing device 76 covers the wider range than the printing range of the recording medium Pa printed by the long-dimension multi-nozzle-type recording heads 70Y and 70B. That is, since a margin exists in heating capability compared with a case where only the printing range is heated, when the range heated by the heating unit is wider than the printing range, ink dryness can be performed efficiently thereby. In addition, more preferably, the range heated by such a heating unit may heat the wider range than the width of the recording medium Pa as shown in FIG. 6.

Moreover, the heating-type ink fixing device 76 is provided at a position subsequent to the recording head 70B (the most downstream end of the conveyance path of the recording medium Pa). However, it is also possible to provide a plurality of such heating units each at a position subsequent to and adjacent to each recording head 70C, 70M, 70Y and 70B. In such a case, it is possible to dry immediately after printing with each color ink is finished, and, thus, it is possible to prevent the respective color inks from being mixed before being dried. Otherwise, Such mixing of respective color inks may produce somber color and thus may cause image quality deterioration.

Furthermore, when another heating unit is allotted to the upstream side of the recording head 70C so that the recording medium Pa may be heated in advance before printing by the recording head 70C starts, more effective ink dryness can be performed.

Next, a second embodiment of the present invention will now be described using FIG. 7.

Figure 7:
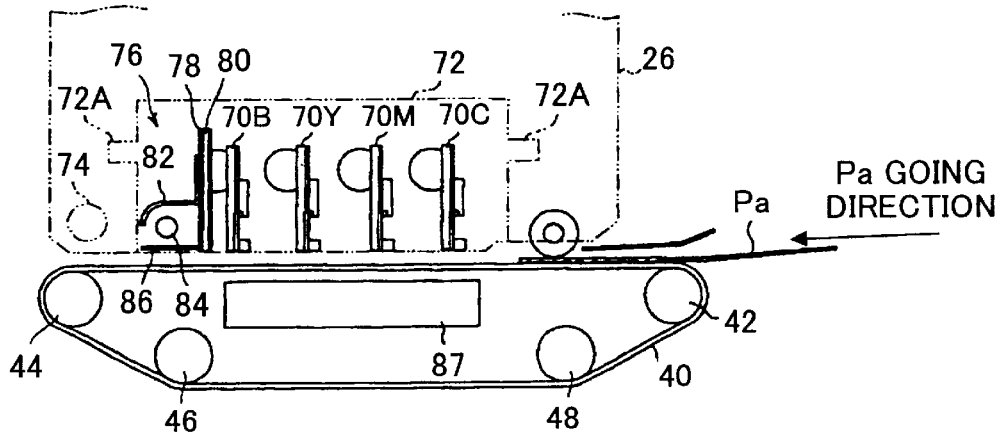
FIG. 7 shows a side-elevational sectional view of a recording part having a heating fixing device in a second embodiment of the present invention.

FIG. 7 shows the second embodiment in which a rear heating unit 87 is additionally provided so that the recording medium Pa can be heated also from the opposite side of the printing surface. The rear heating unit 87 also covers the wider range than the printing range of the recording medium Pa while the heating range extends along the multi-nozzle sequence/row arrangement direction, and thus, effective heating can be achieved. Furthermore, more effective ink heating and dryness are realizable by making the range heated into a larger range than the width of the recording medium Pa.

In addition, also in this embodiment, as the heating unit, a ceramic heater in which a heating element is sintered on the surface thereof, or a lamp-type heater such as a halogen heater may be preferably used. Further, any other type of heater may be used instead. For example, a heating roller having a nichrome wire provided inside thereof, a heating roller in a form of a cylinder glass having a lamp-type light source provided inside thereof, or the like may also be used preferably. Furthermore, a ceramic heater roller having a heating element sintered on the surface thereof may also be used as an efficient heating unit.

Figure 8:
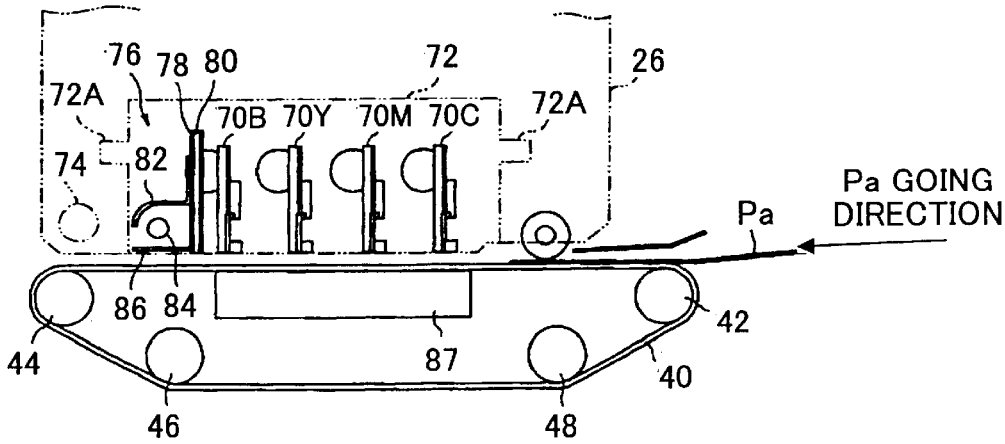
FIG. 8 shows a side-elevational sectional view of a recording part having a heating fixing device in a third embodiment of the present invention.

FIG. 8 shows a third embodiment of the present invention in which such a rear heating unit 87 is made in contact with the conveyance belt 40, and thus is made to perform heating and dryness more effectively.

In this case, heating is made directly by means of the conveyance belt 40 which conveys the recording medium Pa. However, it is also possible to replace the conveyance belt 40 by another conveyance unit, for example, a drum structure (or a roller), and the recording medium Pa is directly heated by using the drum (roller) itself as a heating drum (roller).

Thereby, still more effective heating and dryness is possible.

Also in this embodiment, a heating roller having a nichrome wire provided inside thereof, a heating roller in a form of a cylinder glass having a lamp-type light source provided inside thereof, or the like may also be used preferably. Furthermore, a ceramic heater roller having a heating element sintered on the surface thereof may also be used as an efficient heating unit. Further, the heating unit which acts as the conveyance unit also has the heating range wider than the width of the recording medium Pa, and, thus, the heating unit has a margin in the heating capability.

Figure 9:
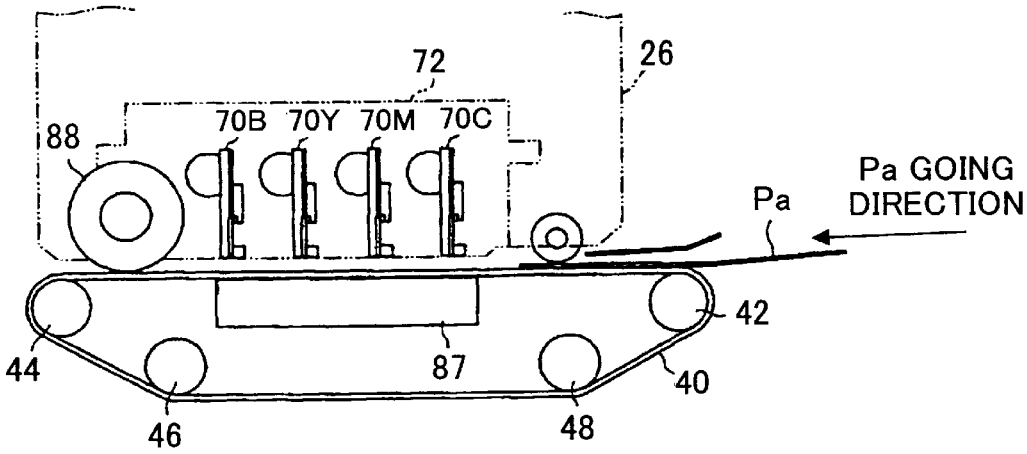
FIG. 9 shows a side-elevational sectional view of a recording part having a heating fixing device in a fourth embodiment of the present invention.

FIG. 9 shows a fourth embodiment of the present invention. In this embodiment, the printing surface is made in contact with and heated and dried by a heating roller 88 directly. In this case, the surface of the heating roller 88 should be made of a material which does not get wet to the ink. As such an ink-repellent material, a fluoride material such as tetrafluoroethylene, silicon rubber or the like may be used.

In this embodiment, since the printing surface of the recording medium is made in contact and heated directly with the heating roller 88, the ink can be dried very efficiently. Moreover, since the heating roller surface is made of the material which does not get wet to the ink, it is possible to avoid ink dots formed on the recording surface from being deformed before being dried. Therefore, it becomes possible to dry and fix the ink on the recording medium Pa more effectively, without degrading the image quality.

In addition, also in this embodiment, as in the various above-mentioned heating units, effective heating can be achieved as the heating range thereof covers the wider range than the printing range of the recording medium Pa while extending along the multi-nozzle sequence arrangement direction. Furthermore, more effective ink heating and dryness is realizable by making the range heated thereby into a larger range than the width of the recording medium Pa.

Moreover, in each of the above-mentioned embodiments, heating and drying may be made not only after printing is performed but also before printing as the various above-mentioned heating unit may be provided in the conveyance path for the recording medium Pa in front of the printing heads, and the recording medium Pa may be heated beforehand. Thereby, effective ink dryness can be achieved.

Next, a configuration of a whole ink-jet copying machine or copier having the heating-type ink fixing device in one of the above-mentioned embodiments of the present invention will now be described.

Generally, a so-called copying machine may be of an electronic photographic type. Although such an electronic photographic type machine has spread widely, in many cases, this type of copying machine may be relatively complicated and also may be relatively large-scaled. In contrast thereto, an ink-jet type recording system is simple in terms of its principle, and, thus, by applying this principle to a copying machine, it should be possible to realize a remarkably simple copying machine.

Figure 10:
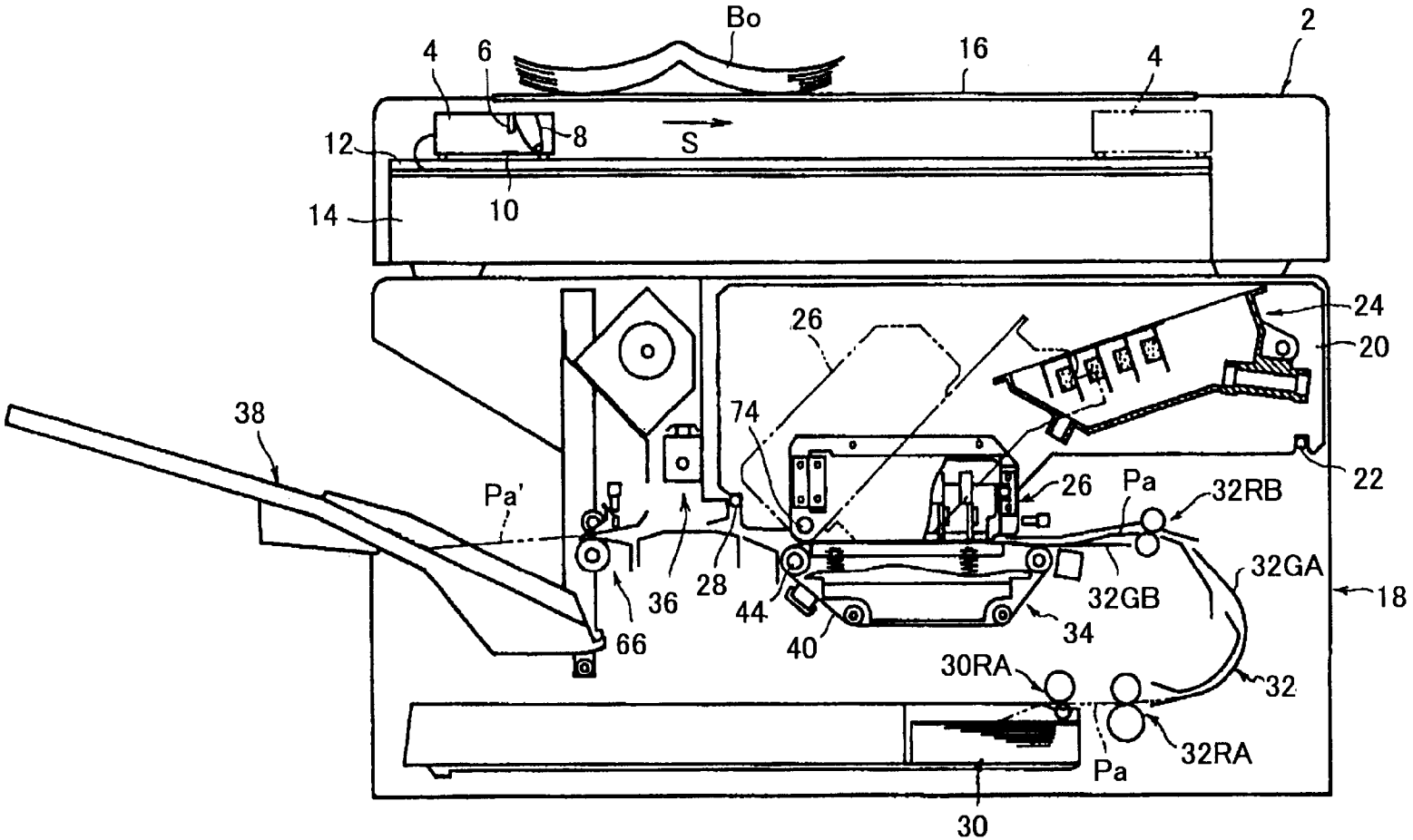
FIG. 10 shows a side-elevational sectional view of a copier employing a recording part having a heating fixing device in a fifth embodiment of the present invention.

FIG. 10 shows a side-elevational sectional view of an ink-jet copying machine in a fifth embodiment of the present invention.

In FIG. 10, the ink-jet copying machine includes a scanner part 2, a recording part 26, a conveyance part 34, an ejecting paper conveyance part 36, a feeding paper conveyance part 32, and a recovery processing device 24.

The scanner part 2 reads an image of an original Bo placed on an original stand 16. The recording part 26 fires ink and makes it adhere to a recording surface of a paper Pa as a recording medium in sequence based on the image data supplied from the scanner part 2 which generates the image data. The conveyance part 34 is allotted on the downstream side of the recording part 26 which performs the record operation, and conveys the paper Pa in predetermined timing according to the recording operation of the recording part 26, to the ejection paper conveyance part 36. The ejection paper conveyance part 36 ejects the printed paper Pa' which is conveyed by the conveyance part 34 onto an ejection tray part 38. The feeding paper conveyance part 32 conveys one sheet of paper Pa from a feeding part 30 to the recording part 26 at a time. The recovery processing device 24 performs predetermined recovery processing selectively onto each recording head of the recording part 26.

The scanner part 2 includes an original scanning unit 4, a guide rail 12, and a driving unit (not shown in the figure). The original scanning unit which reads an image of the original Bo which should be copied as mentioned above. The guide rail 12 supports the original scanning unit movably along a direction indicated by an arrow S in the figure, and also, movably along the opposite direction. The driving unit drives the original scanning unit 4 so as to realize going and returning operation thereof between a position shown by a solid line and a position shown by a broken chain line at a predetermined speed.

The original scanning unit 4 mainly includes a rod-array lens 6, an line sensor 10 of a unity-magnification color decomposition type as a color image sensor for reading color information, and an exposure unit.

When the original scanning unit 4 is moved along the arrow S so as to read the image on the original Bo placed on the original stand made of a transparent material, a lamp of the exposure unit 8 is turned on, and, the reflected light from the original is condensed onto the line sensor 10 through guidance by the rod array lens 6. The line sensor 10 reads the color image information of the reflected light for each color component, converts it into an electric signal, and provides the signal to a control unit of an ink-jet printer part 18. The recording head for each color component in the recording part 26 fires liquid, for example, ink of a predetermined different color according to a driving control pulse signal produced based on the thus-produced image data.

When a drive motor, not shown in the figure, is made into an operation state, one sheet of paper Pa in a predetermined standard size loaded in the feeding part 30 is taken out at a time by a pickup roller unit 30RA, and is supplied to the feeding paper conveyance part 32.

According to the ink-jet recording scheme, a small drop of ink is fired out from each nozzle of the recording heads, it is made to adhere to the recording surface of the paper, such as paper Pa, and, thus, recording thereon is achieved. Accordingly, the paper Pa should be such that the ink does not spread on the paper beyond necessity, and the printed image does not fade problematically. Moreover, it is preferable that the paper should be such that the ink adhering thereto is promptly absorbed into the inside thereof. Furthermore, it is preferable that the paper should be such that, even when the inks of different colors are laid one each other and adhere in a short time at a same part on the paper Pa, the ink should not flow out or ooze out much, and thus, spread of each printed dot can be controlled appropriately so that the clearness of quality of the image should not be spoiled.

These features may not be sufficiently fulfilled by a copy paper called regular paper used generally in a copying machine of an electronic photographic type, etc. That is, such a type of paper is approximately satisfactory in a condition in which only single color is used for printing or inks of only two colors are laid on one another on recording medium. However, such a type of paper may not be satisfactory in resulting image quality in a condition in which inks of three or more colors are laid on one another, and, thus, the amount of inks to adhere to a recording medium should be increased accordingly.

As a high-quality paper which can be satisfactory even in such a rigorous printing condition, paper in which coating is made (for example, fine-powder silica acid) by which the above-mentioned special features are acquired on a base material may be used.

Thus, since the ink-jet copying machine in the fifth embodiment of the present invention has the heating-type ink fixing device which covers the wider range as mentioned above than the width of the recording range of the recording medium, it has a margin in the ink-fixing capability. Therefore, high speed, high definition, quality printing and copying can be achieved, without rear penetration of non-dried ink also in a case of a continuous copying operation, since the ink is dried and fixed momentarily thanks to the above-mentioned sufficient ink fixing capability. Especially, in case of high-speed printing and copying thanks to a long-dimensional multi-nozzle type ink-jet recording head in which a plurality of ink firing nozzles can cover a printing range of a recording medium, the copying machine according to the present invention which has the sufficient capability of ink fixing performance as mentioned above enables practical and positive realization of the performance thereof.

Further, the present invention is not limited to the above-described embodiments, and variations and modifications may be made without departing from the scope of the present invention.

The present application is based on Japanese priority applications Nos. 2001-188723 and 2002-120163, filed on Jun. 21, 2001 and Apr. 23, 2002, respectively, and the entire contents of which are hereby incorporated by reference.

What is claimed is:

1. An ink-jet recording device comprising:

a multi-nozzle recording head having heating elements in a density in a range between 400 and 2400 dpi arranged on a substrate, wherein ink is fired through a nozzle by a function of growth of air bubble generated in a recording liquid in each heating element; and a recording medium heating unit for heating a recording medium, said heating unit extending along a direction along which the nozzles of said recording head are arranged, said heating unit having a heating range, the width of which is wider than the width of a printing range of the recording medium, wherein said multi-nozzle recording head has a long dimension so as to cover the printing range of the recording medium which is conveyed by a conveyance unit to a position at which the nozzle surface of said recording head face said recording medium, and wherein said heating unit heats a printed surface of the recording medium without contacting the recording medium.

2. The ink-jet recording device as claimed in claim 1, further comprising a rear heating unit provided on the rear side of the recording medium, having a heating range extending along the direction along which the nozzles of said recording head are arranged, the width of the heating range being wider than the width of printing range of the recording medium.

3. The ink-jet recording device as claimed in claim 2, wherein said rear heating unit heats the recording medium without contacting the rear side of the recording medium.

4. The ink-jet recording medium as claimed in claim 1, wherein said heating unit has a light source and an optical system condensing the light emitted by said light source.

5. An ink-jet recording device comprising:

a multi-nozzle recording head having heating elements in a density in a range between 400 and 2400 dpi arranged on a substrate, wherein ink is fired through a nozzle by a function of growth of air bubble generated in a recording liquid in each heating element; and a recording medium heating unit for heating a recording paper having a material coated on a base material, said heating unit extending along a direction along which the nozzles of said recording head are arranged, said heating unit having a heating range, the width of which is wider than the width of a printing range of the recording paper, wherein said multi-nozzle recording head has a long dimension so as to cover the printing range of the recording paper which is conveyed by a conveyance unit to a position at which the nozzle surface of said recording head face said recording paper, and wherein said heating unit heats a printed surface of the recording paper without contacting the recording paper.

6. An ink-jet copier comprising:

a scanner part reading an image of an original;

a recording part performing a recording operation by firing ink onto a printing surface of a recording medium based on image data supplied from said scanner part; and a recording medium heating unit for heating the recording medium, said heating unit extending along a direction along which the nozzles of said recording head are arranged, said heating unit having a heating range, the width of which is wider than the width of a printing range of the recording medium, wherein said recording part comprises a plurality of recording heads for respective color components each having heating elements in a density in a range between 400 and 2400 dpi arranged on a substrate, wherein ink is fired out through a nozzle by a function of growth of air bubble generated in a recording liquid in each heating element which is driven according to the image data, wherein said each recording head has a long dimension so as to cover the printing range of the recording medium which is conveyed by a conveyance unit to a position at which the nozzle surfaces of each recording head face the recording medium, and wherein said heating unit heats a printed surface of the recording medium without contacting the recording medium.

7. An ink-jet copier comprising:

a scanner part reading an image of an original;

a recording part performing a recording operation by firing ink onto a printing surface of a recording medium based on image data supplied from said scanner part; and a recording medium heating unit for heating a recording paper having a material coated on a base material, said heating unit extending along a direction along which the nozzles of said recording head are arranged, said heating unit having a heating range, the width of which is wider than the width of a printing range of the recording paper, wherein said recording part comprises a plurality of recording heads for respective color components each having heating elements in a density in a range between 400 and 2400 dpi arranged on a substrate, wherein ink is fired out through a nozzle by a function of growth of air bubble generated in a recording liquid in each heating element which is driven according to the image data, wherein said each recording head has a long dimension so as to cover the printing range of the recording paper which is conveyed by a conveyance unit to a position at which the nozzle surfaces of each recording head face the recording paper, and wherein said heating unit heats a printed surface of the recording paper without contacting the recording paper.

* * * * *